US005578905A

United States Patent [19]

Graber

[11] Patent Number: 5,578,905

[45] Date of Patent: Nov. 26, 1996

[54] FLOW-RESPONSIVE AIR PURGED PORTABLE ELECTRIC LAMP

[75] Inventor: Warren S. Graber, Inverness, Ill.

[73] Assignee: Woodhead Industries, Inc., Buffalo Grove, Ill.

[21] Appl. No.: 540,643

[22] Filed: Oct. 11, 1995

[51] Int. Cl.[6] ..... H01K 7/00

[52] U.S. Cl. ..... 315/76; 362/21; 362/22; 362/267; 362/158; 315/362

[58] Field of Search ..... 315/76, 362; 362/21, 362/22, 267, 158

[56] References Cited

U.S. PATENT DOCUMENTS 4,276,580 6/1981 Rogers ..... 362/22
5,519,587 5/1996 Baggio et al. ..... 362/21

*Primary Examiner*—Robert Pascal
*Assistant Examiner*—Michael Shingleton
*Attorney, Agent, or Firm*—Emrich & Dithmar

[57] ABSTRACT

A portable electric lamp suitable for use in hazardous locations includes a fixture which is purged continuously with air during operation. Pressurized air is introduced at an input end of the fixture, through a plenum which establishes a generally laminar flow of air through the fixture during purging. To insure that the fixture is satisfactorily purged before power is applied to the lamps, differential pressure is measured over a precision orifice at the discharge end of the lamp, and total flow is determined. During the start-up cycle, pressure within the fixture must exceed a predetermined minimum threshold; but following start-up, the operating pressure may drop lower than the initial minimum pressure, as long as a positive pressure is maintained within the fixture.

10 Claims, 3 Drawing Sheets

FLOW-RESPONSIVE AIR PURGED PORTABLE ELECTRIC LAMP

FIELD OF THE INVENTION

The present invention relates to portable electric lamps; and more particularly to a portable electric lamp suitable for use in "hazardous" locations. The term "hazardous" is a term of art in this connection, and its meaning is known to those in the industry. It includes operation in environments in which volatile materials are present, such as in oil refineries or certain manufacturing locations using solvents or other combustible materials. So-called "hazardous" locations are common in airplane manufacturing facilities, chemical production facilities and many other places.

BACKGROUND OF THE INVENTION

Portable lighting is often used in hazardous locations. In the past, incandescent lamps have been widely used in hazardous locations. However, incandescent lamps may break if dropped, thereby exposing the heated filament as well as the electrical power leads to the environment. This may create a potential for an explosion, depending upon the conditions in the environment of which the lamp is used.

Attempts have been made to make incandescent lamps "explosion proof". This has required expensive and elaborate provisions for shielding and enclosing the lamp, and for reinforcing the enclosure for the lamp since the enclosure must be transparent (or at least translucent) and normally is made from special glass. By way of example, one commercial incandescent lamp designed for use in hazardous locations includes a very thick and strong globe of special explosion-proof glass which surrounds the lamp. A metal framework is placed around the globe for coupling to the base of the fixture. These units are expensive, and heavy; and it is time-consuming to replace a burned-out lamp due to the construction of the unit. Further, re-lamping of this type of unit cannot always be accomplished in the "hazardous" location. Sometimes, the lamp must be removed from that location before a new lamp can be installed.

An improved hazardous location lamp using fluorescent electrical lamps is disclosed in the co-pending, co-owned application of Baggio and Granat for AIR PURGED PORTABLE ELECTRICAL LAMP, application Ser. No. 08/431,308. The use of fluorescent lamps over incandescent lamps is known to provide better efficiency. In the improved fluorescent hazardous location lamp, air pressure within the fixture housing is monitored by a low pressure switch and a high pressure switch. These two switches define a design operating range for the pressure inside the fixture. A control circuit includes a timer circuit which commences timing when power is applied to the fixture. Pressurized air (which originally was required to be breathable air, but now must merely be filtered) is applied to the fixture at the same time. The time duration of the timer circuit is set as a function of the known air volume within the fixture. Thus, the start-up cycle for this system requires that the internal pressure be maintained within the design range for a predetermined time to insure that the desired number of volumes of the interior of the fixture will be purged. (For start-up, it is now accepted by the National Fire Protection Association that four times the volume of the interior of the fixture is acceptable for purging to establish safe initial conditions.) If the pressure within the housing is maintained within the design limits, and the timer times out, then power is applied to the lamps.

One problem with this type of fixture, though considered to be an improvement over other available, more costly and heavy incandescent fixtures for hazardous locations, is that safe operation of the system is dependent upon the integrity of the enclosure of the fixture and the integrity and reliability of the pressure switches which are mechanical switches and may stick in one state. For example, if the discharge orifice becomes plugged (which happens in industrial environments), but there is a leak in the end cap of the fixture, through which the breathable air is introduced, then the starting conditions may be established but it is possible that the incoming air is escaping directly into the atmosphere adjacent the air inlet, and the remainder of the fixture (which, in the case of tandem fluorescent lamps may be approximately four feet long), remains unpurged.

SUMMARY OF THE INVENTION

The present invention is similar to the improved portable electric lamp disclosed in the co-pending application identified above in that it is intended to operate fluorescent lamps, although the invention could readily be adapted to operate other types of lamps such as high intensity discharge (HID) lamps or even incandescent lamps.

In the illustrated embodiment, the housing is of generally uniform cross-sectional area, and it is elongated to accommodate two pairs of fluorescent lamps arranged in end-on-end relation. That is, two fluorescent lamps are placed adjacent one another, and another pair of fluorescent lamps is placed in tandem with the first pair, thus the housing could be up to four feet long. This style of lamp is desirable because of the greater area over which light is provided.

Filtered air is introduced at one end of the lamp (called the inlet end). Filtered air is acceptable under industry standards recently established, but in theory inert gas or other non-combustible gas could equally well be used; and the term "air" is thus intended to include such equivalent gases. After passing through a regulator within the housing for the fixture, the air is introduced into a plenum at the air inlet end of the housing so that air flows through the housing in a generally laminar flow.

At the other end (the discharge end) of the lamp housing, there is a precision orifice through which the breathable air discharges into the atmosphere. The pressure is measured across this orifice, and an electrical signal is generated representative of this differential pressure. The electrical pressure signal is then fed to a voltage-to-frequency converter which generates a signal having a frequency representative of the pressure differential across the precision orifice. That is, the higher the frequency, the greater is the pressure difference and, thus, the flow rate. Total or accumulated flow is proportional to the integral pressure.

The frequency signal is fed to a first counter, sometimes referred to as the integrating counter, for generating a total count representative of the accumulated volume of air or integrated flow. A second counter generates a signal representative of the time within which the start-up cycle must be completed. Before a start-up cycle begins, the counters are held, in reset, so the stored information in the integrating counter actually represents cumulative flow for a start-up cycle. Start-up begins when the sensed pressure across the precision orifice reaches a predetermined value, 10 in WC in. the illustrated embodiment, but it may fall to as low as 3 in. WC after the start-up cycle.

When the cumulative flow signal reaches a predetermined value during start-up, representative of four complete volumes of space within the interior of the fixture housing, having been forced through the housing, power is fed from the input power leads through a pair of semiconductor TRIAC switches connected in series to power the fluorescent lamps. If at any time following start-up, the pressure across the precision orifice drops below 3 in. WC, the lamps are shut off and a red LED indicator is illuminated. A start-up cycle will re-initiate automatically when pressure exceeds 10 in. WC, and a yellow indicator is illuminated to signal that condition.

Sensing circuitry determines when either of two series-connected TRIAC switches fails or when pressure exceeds a predetermined high level (32 in. WC) deemed unsafe for operation. If either condition is sensed, the system is shut down and a red "failure" indicator is lit, requiring operator attention before the lamps can be re-started.

The control circuitry for determining that safe conditions have been achieved is embedded in epoxy which is considered an inherently safe material, so that the fixture is safe for operation in hazardous locations.

Other features and advantages, particularly fault detection and status indicator circuits, are included in the present invention and will better understood by persons skilled in the art from the following detailed description of a preferred embodiment accompanied by the attached drawing wherein identical reference numerals will refer to like parts in the various views.

DETAILED DESCRIPTION OF A PREFERRED EMBODIMENT

Figure 1:
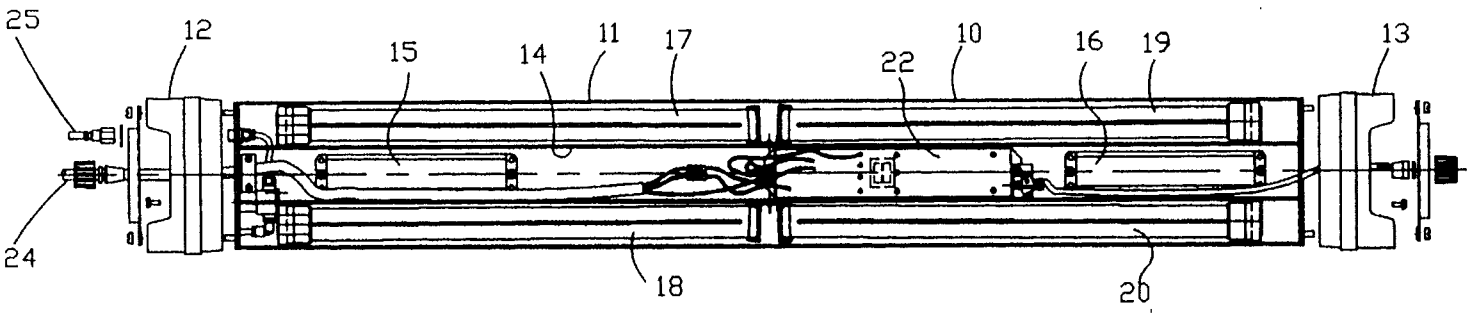
FIG. 1 is a plan view of a portable light fixture constructed according to the present invention with the components of the end cap assemblies in exploded relation, and with a portion of the cover removed to view the interior of the fixture.

Referring first to FIG. 1, reference numeral 10 generally designates an air-purged portable electric fluorescent lamp fixture constructed according to the present invention and suitable for use in hazardous locations. The fixture 10 includes a light-transmissive (preferably transparent) housing 11 (the upper portion of which is removed in the drawing so the interior can be viewed). The ends of the housing 11 are received in left and right end cap assemblies designated respectively 12 and 13. Located inside the fixture is a frame 14 on which first and second ballasts 15, 16 are mounted. The ballast 15 energizes a first pair of fluorescent lamps 17, 18; and the ballast 16 energizes lamps 19, 20. Further details of the mechanical mounting of the ballasts and lamps, as well as the structure of the frame 14 and its mounting within the end cap assemblies can be found in U.S. Pat. 5,088,015 for "PORTABLE FLUORESCENT LAMP FIXTURE", the disclosure of which is incorporated herein by reference.

An electronic control module 22 is also mounted on the frame 14. Control circuitry, seen in FIG. 6 and described below, is enclosed in epoxy potting compound for sealing the circuit elements, and is housed in control module 22. An electrical power cord 24 which may be provided with a hazardous duty plug for connecting to a wall outlet or hard-wired, extends through the left end cap assembly 12 as will be described further below, and is routed through the interior of the fixture to the control module 22. A flexible tubular conduit 25 is connected to a source of pressurized filtered air (not shown) and serves as a conduit for pressurized air into the interior of the fixture 10, as will also be described further below.

Figure 3:
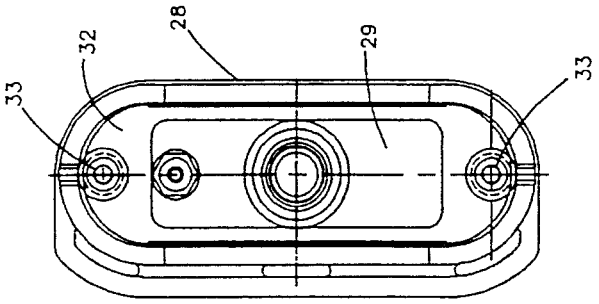
FIG. 3 is a vertical left-side view of the input end cap of the structure of FIG. 1.
Figure 2:
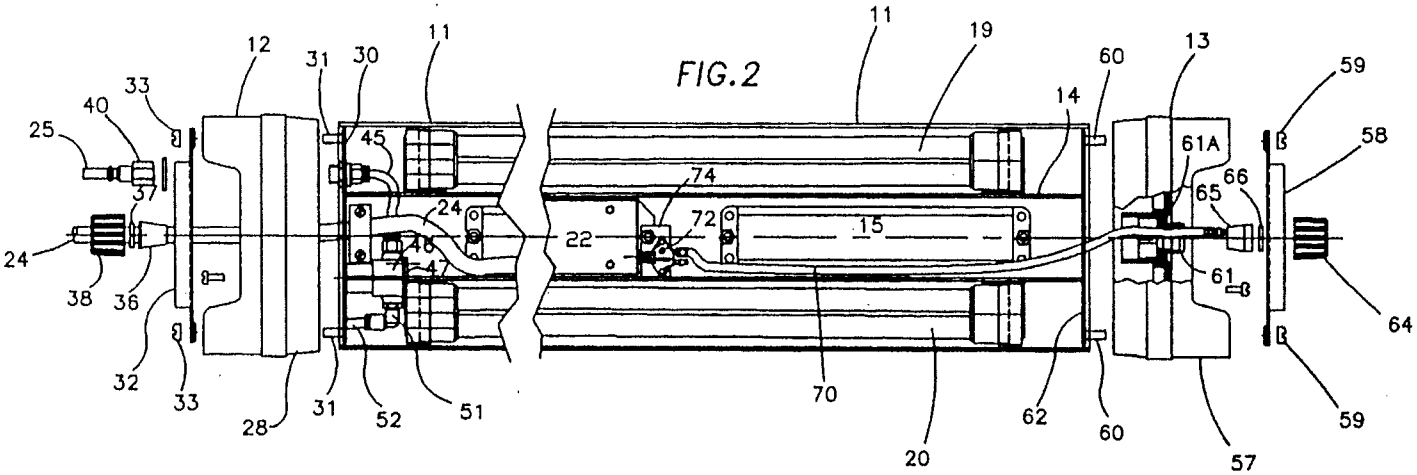
FIG. 2 is an enlarged fragmentary view of the fixture of FIG. 1 with the middle portion removed for enlargement purposes.

Turning now to FIG. 2, the left end cap assembly 12 includes a rubber end cap 28. The right side of the end cap 28 includes a peripheral flange for fitting over the left end of the housing 11. As seen best in FIG. 3, the end cap 28 includes a transverse wall 29. A plenum wall 30 (shown in FIG. 4) is mounted to the left side of the frame 14 and spaced slightly from the intermediate wall 29 of the end cap to form an air plenum on the left (or "input") end of the housing 11.

The plenum wall 30 includes a pair of mounting studs 31 which fit through apertures in the transverse wall 29 of end cap 28, and also through suitable holes in a reinforcing bracket generally designated 32 which is received on the outer surface of the intermediate wall 29. Fasteners 33 secure the reinforcing bracket 32 to the studs 31 and provide a compression mounting for end cap 28 to the fixture (that is, directly to the frame 14).

The electrical cord 24 is fed through the reinforcing plate 32, the transverse wall 29 of end cap 28 and the center aperture 35 of the plenum wall 30. The cord 24 is sealed to the end cap by means of a conical grommet 36, fixture washer 37, and internally threaded compression nut 38 which is received on an externally threaded nipple molded into the intermediate wall 29 and extending through the reinforcing plate 32, similar to the nipple 61 described further below.

The air conduit 25 includes a female coupling 40 which is received on a corresponding male coupling 41 mounted to the end wall 30 and extending through the intermediate wall 29 of the end cap. A washer 42 is received on the externally threaded male fitting 41 adjacent the nut of the female fitting 40.

A section of tubing 45 couples the incoming pressurized air from the male fitting 41 to a pressure regulator 46 which is mounted by means of a bracket 47 to the frame 14 of the fixture.

Figure 4A:
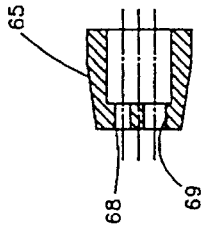
FIG. 4 and 4A are a vertical end views of the plenum wall inside the housing.
Figure 4:
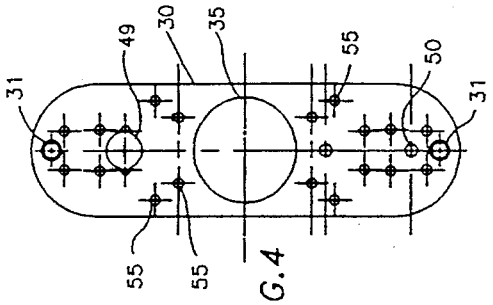

Turning now to FIG. 4, plendum wall 30 includes a number of different apertures including the aperture 35, already described, through which the electrical cord 24 is routed. It also includes an opening 49 for receiving the male pneumatic fitting 41 for incoming air fed to the regulator 46. The wall also includes an aperture 50 through which air is forced via an elbow fitting 51 and short tubular section 52 from the regulator 46 into the plenum which, as mentioned, is formed between the plendum wall 30 and the transverse wall 29 of the end cap. The plenum, thus, is filled with air from the regulator. The plenum wall 30 also includes a larger number of spaced, smaller apertures 55 through which the forced air flows in the direction of elongation of the fixture, parallel to the fluorescent lamps to purge the interior of the housing 11 of whatever atmosphere it had contained. The apertures 55 in the end wall 30 create a substantially laminar flow through the fixture in purging the interior of the fixture.

Turning now to the right end cap assembly 13, it includes a rubber end cap 57 and a reinforcing plate 58, similar to previously described reinforcing plate 32. Fasteners 59 secure the reinforcing plate 58 and end cap 57 to studs 60 mounted on a right end wall 62 mounted to the frame A nut 59 secures the reinforcing bracket 58, end cap 57 and a flow controller 65 a nipple 61 molded into a transverse wall 61A of end cap 57. The flow controller 65, as best seen in FIG. 4A, contains an upper aperture 68 and a precision orifice. The electronic control module measures the pressure across the precision orifice 69 in controlling the operation of the fixture. The aperture 68 couples a reference pressure representative of the ambient pressure of the atmosphere external to the fixture by means of a conduit or tube 70 to a differential pressure sensor generally designated 72 in FIG. 2. The sensor 72 is mounted by means of a bracket 74 to the electronic control module 22 (FIG. 2).

ELECTRICAL WIRING AND ELECTRONIC CONTROL MODULE

Figure 5:
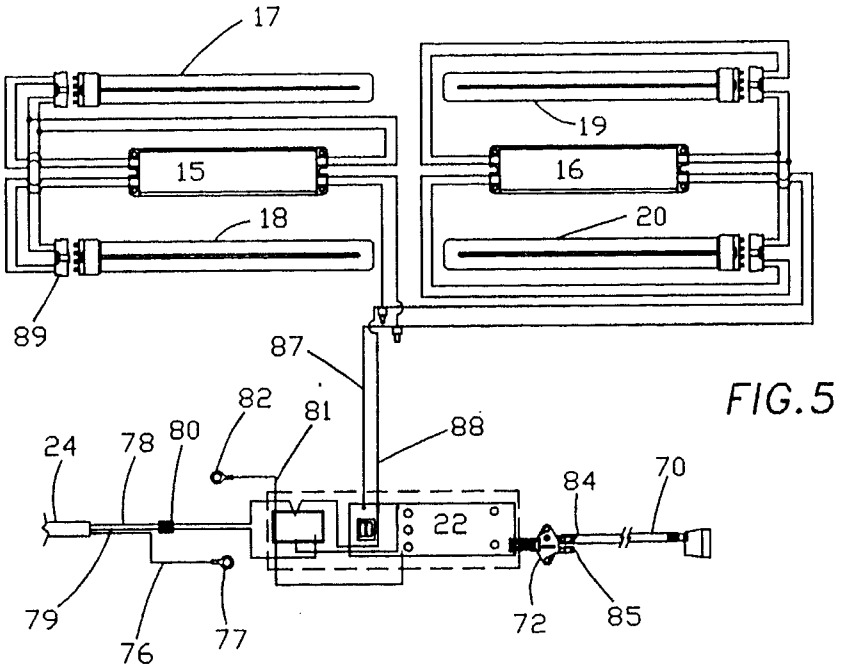
FIG. 5 is a schematic wiring diagram of the fixture of FIG. 1.

Turning now to FIG. 5, the input power electrical cord 24 includes a ground wire 76 which is connected to the frame 14 by means of a connector lug 77, and first and second power leads 78, 79. The power leads are connected by a hazardous duty connector terminal 80 to the control module 22 which, itself, includes a ground lead 81 connected to the frame by means of a connecting lug 82. The inlet ports of the differential pressure sensor 72 are designated respectively 84 and 85. The inlet port 84 communicates the ambient pressure by means of the conduit 70 and aperture 68 of the flow controller 65, previously described, to control module 22. The inlet port 85 of the differential pressure sensor 72 senses pressure within the housing of the fixture. The four output leads of the differential pressure sensor are connected directly to the electronic control module 22; and the output leads of the control module 24 which are designated 87 and 88 in FIG. 5 are connected to the ballasts 15, 16 in parallel. As indicated above, ballast 15 excites lamps 17 and 18 in parallel; and ballast 16 excites lamps 19 and 20 in parallel. All of the lamps are mounted by means of conventional sockets such as the one designated 89 in FIG. 5 for fluorescent lamp 18.

Figure 6:
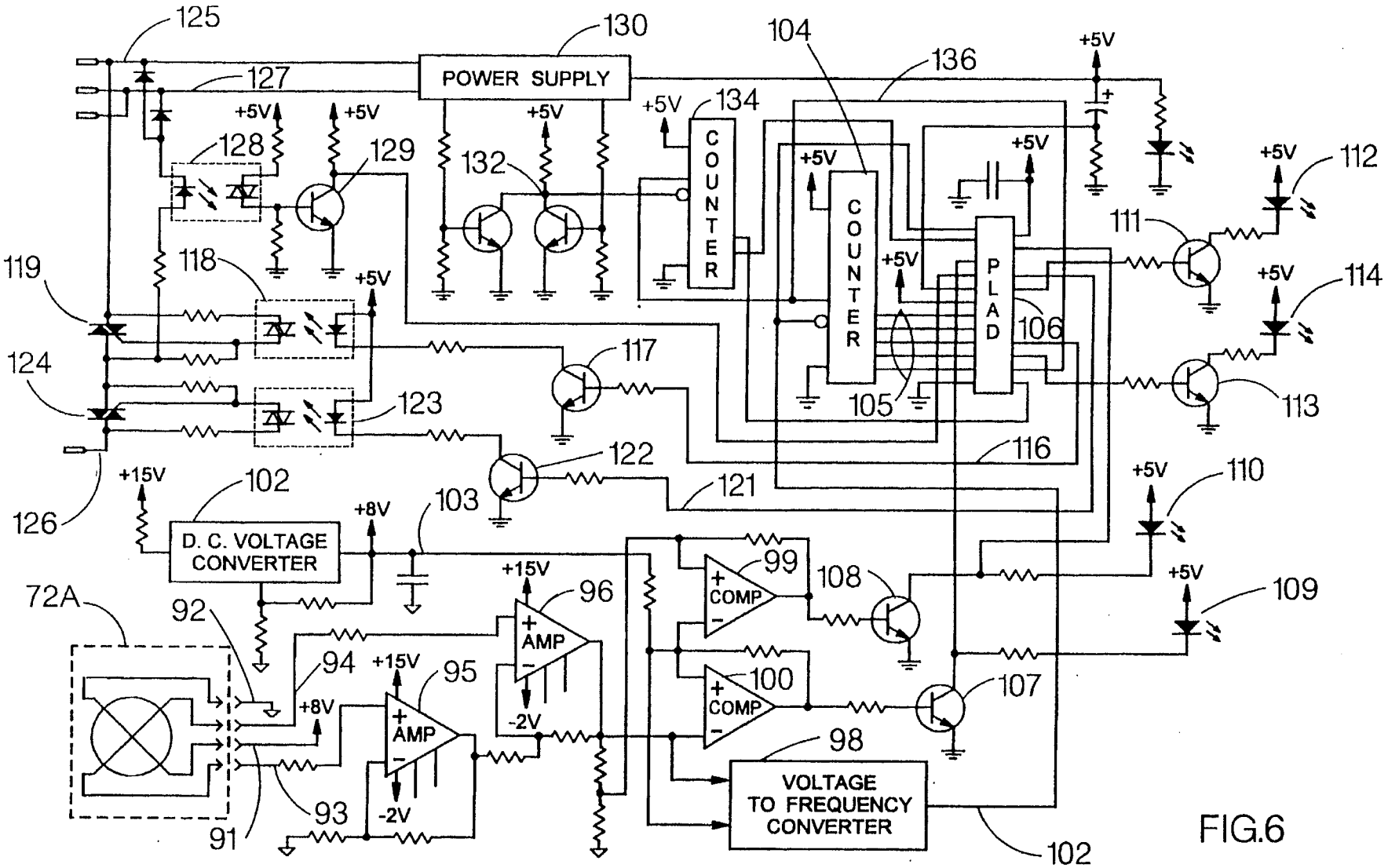
FIG. 6 is a circuit schematic diagram partly in functional block form, of the electric control circuitry for the fixture.

Turning now to FIG. 6, differential pressure sensor 72 is schematically shown within dashed line 72*a*. All of the other circuitry shown in FIG. 6 other than the pressure sensor within block 72*a* is embedded in epoxy and thus considered suitable for use in hazardous environment. Sensor 72 is a conventional differential pressure sensor taking the form of an electrical bridge circuit and including four leads. A lead 91 connects the sensor to a power supply; and a lead 92 connects the sensor to ground. Leads 93 and 94 connect signal outputs of the sensor respectively to the inputs of operational amplifiers 95, 96 which, together, form a differential amplifier, the output signal of which is an analog signal representative of the difference in pressure across precision orifice 69 of the flow controller 65 (FIG. 4A). That is, one input signal (fed to amplifier 95) is representative of the ambient pressure sensed by aperture 68 of the flow controller 65; and the other input is the internal fixture pressure sensed by input port 85 of the differential pressure sensor 72.

The output signal of the differential amplifier (which is the same as the output signal of amplifier 96) is coupled to (i) one input of a voltage to frequency convertor 98, (ii) the positive input of a first comparator 99, and (iii) the negative input of a second comparator 100. A DC voltage converter 102 generates a reference voltage on an output line 103 which is coupled to the negative input of comparator 99 and the positive input of comparator 100, as well as to a second input of the voltage to frequency converter 98. The signal on line 103 is a reference which represents a pressure level of 3.0 in. WC to the positive input of comparator 100 and a pressure of 10.0 in. WC to the negative input of comparator 99, as further described below.

The voltage to frequency converter 98 receives the reference signal and the signal from the differential amplifier representative of the differential pressure across the precision orifice of the flow controller 65, and generates an output signal on line 102 having a frequency which is representative of the sensed pressure. The output of the voltage to frequency converter 98 is a series of voltage pulses; and that signal is fed to the input of a first counter circuit 104, sometimes referred to as the integration counter because it accumulates the incoming pulse signals from converter 98 to generate an accumulated count representative of the total flow of gas through the precision orifice 69 of the flow controller. Counter 104 (as well as a counter 134 yet to be described) are held in reset until the internal pressure reaches a predetermined level (10 in. WC), as signaled by the switching of comparator 99. The accumulated count of counter 104 is fed via parallel lines 105 to a programmable Logic Array Device (or PLAD for short) 106.

The output of comparator 100 is coupled through a transistor driver 107 to an input of the PLAD 106 and the output of comparator 99 is coupled through a transistor 108 to the PLAD. An LED 109 is connected in the emitter circuit of transistor 107; and an LED 110 is connected in the emitter circuit of transistor 108. One output of the PLAD 106 is connected to a transistor 111 having an LED 112 connected in its emitter circuit; and another output of the PLAD 106 is connected to a transistor 113 having an LED 114 connected in its emitter circuit.

Another output of the PLAD 106 is connected by means of a lead 116 to a transistor driver 117 the output of which is connected to an optical isolation circuit generally designated 118. The output of the optical isolation circuit 118 is connected to the gate circuit of a first TRIAC semiconductor switch 119. Another output of the PLAD 106 is connected by means of a lead 121 to a second transistor driver 122, which is connected in circuit to drive a second optical isolation circuit 123, the output of which is coupled to the gate circuit of a second TRIAC 124. The TRIACs 119 and 124 are connected in series between a power input lead 125 and a power output lead 126. A second input lead 127 represents AC ground.

An optical isolation circuit 128 is connected between the junction of the TRIACs 119, 124 and the ground lead 127. The output of the optical isolation circuit 128 feeds a transistor 129, the output of which is connected to an input of the PLAD 106.

A power supply 130 receives power from the input leads 125, 127 and generates the necessary supply voltages, as well as a constant signal at a junction 132 by means of a conventional resistive divider network and drive circuitry. The signal at the junction 132, representing a constant voltage, is fed to the clock input of a counter circuit 134. When a signal is present on junction 132 and the counter reset is removed (i.e. goes to 0), the counter 134 begins to count; and the stored count of the counter 134 is thus a clock or timing signal to generate a timing signal representative of a fixed time. The primary function of the counter 134 is to set a minimum and a maximum time during which a purge cycle must be completed. The signals are received by the PLAD.

OPERATION

In operation, under normal conditions, before the pressure is turned on, the pressure within the fixture is the same as atmospheric pressure, so the differential amplifier generates a signal representative of zero pressure across the precision orifice, and thus no flow through the orifice. Comparator 100 generates a signal which is fed via driver transistor 107 to the PLAD 106 which, in turn, generates a signal on line 136 to hold counters 104 and 134 in reset. When the pressure is turned on, the signal from the differential amplifier representative of the differential pressure increases.

The PLAD also receives a signal from comparator 99, driver 108 and holds the counters in reset until the pressure across the flow controller increases to 10 in. WC, at which time, a signal is fed from comparator 99 to the PLAD 106 to start or "enable" the counter (by removing the reset signal).

The counters will continue to count until the PLAD senses that the timer counter 135 has reached a maximum time for purging to have occurred (the "maximum purge time").

If the maximum purge time has passed before the integrating counter accumulates a count representative of the desired number of volumes of air passed through the fixture, then the PLAD will interrupt operation and hold the counters in reset until a new purge start-up cycle is initiated. By way of example, in the illustrated embodiment, the count in the integrating counter 104 must reach a value such that an amount of air equal to four volumes of the interior of fixture have passed through the controller within three minutes after a start-up cycle has been initiate. If this does not happen the system will sense the condition and shut down until a subsequent start-up cycle is initiated. When pressure is first applied, and it exceeds 10 in. WC, comparator 99 switches and the counter reset signal is removed so that both counters begin counting. If the count in the integrating counter 104 reaches a value representative of four volumes of purged air before the maximum purge time is reached in the time counter 134, the PLAD sends signals along lines 116, 121 to switch the TRIACS 119, 124 to commence operation of the fluorescent lamps. PLAD also drives transistor 113 to light indicator 114 (green) to signal a completed start-up cycle and normal operation. Once the fixture is fully purged during a start-up cycle, pressure may drop below 10 in. WC down to 3 in. WC without interrupting operation.

If, on the other had, the pressure falls below 10 in. WC during a start-up cycle before the system determines that four volumes of air has passed through the fixture, the PLAD will inhibit the counter and operation must begin over.

If, after a successful start-up cycle has concluded, the pressure falls below 3 in. WC, indicator 109 (red) is lit and the system is shut down, but can be re-started by reapplying proper pressure.

If, during startup, the pressure differential across flow controller 65 is relatively high but below a preset maximum (32 in. WC), then the counter 104 will reach its predetermined count (which is preferably representative of four complete purges of the volume of air within the fixture), in a shorter time, indicating that the required purging is completed in a shorter period of time because more air is passing through the precision orifice. A typical range of times during which the integration counter 104 reaches its predetermined count is from three minutes to fifty seconds (the latter representing the highest acceptable differential pressure across the precision orifice and, thus, greater flow of purging air through the fixture). If the integrating or accumulating counter 104 reaches its predetermined count representative of four volumes of air having passed through the flow controller before the timer counter 134 indicates that fifty seconds has passed, the PLAD 106 senses this condition and determines that a fault (e.g. excessive pressure) has occurred, and disables further operation and actuates indicator (red) 112. If the PLAD senses that too long a time has passed, as indicated in timer counter 134 and the predetermined count has not been reached in counter 104, this also is determined to be a fault, and operation is disabled and indicator 112 lit. However, in the later case a start-up cycle may be reinstated, after adjusting pressure.

If the integration counter 104 accumulates its predetermined count with no fault detected by timer counter 134, the PLAD 106 generates signals along lines 116 and 121 to cause the TRIACs 119, 124 to conduct and thereby couple power from the lead 125 to the lead 126 and thence to leads 87, 88 in FIG. 5 to energize the ballasts and thus the lamps.

If there is a failure in one of the TRIAC switching devices, for example, if either TRIAC 119 or TRIAC 124 fails (i.e. becomes shorted) a signal will be coupled by the optical isolation circuit 128 to switch transistor 129. This signal, in turn, is fed to the PLAD 106 which generates an inhibit signal on leads 116, 121 and prevents further operation. Transistor 111 is driven by the output of the PLAD 106 and it is switched to energize indicator 112 (red) if either there is a fault in one of the TRIACs, as indicated above, or the system pressure is sensed to be greater than 32 in. WC at any time during operation.

Having thus disclosed in detail a preferred embodiment of the invention, persons skilled in the art will be able to modify certain of the components or circuitry which has been disclosed and to substitute equivalent elements for those illustrated while continuing to practice the principle of the invention; and it is, therefore, intended that all such modifications and substitutions be covered as they are embraced within the spirit and scope of the appended claims.

I claim:

1. A portable electric lamp suitable for operation in hazardous locations comprising: a housing including a light-transmissive wall portion; a lamp circuit including a lamp in said housing; electrical power leads for coupling power into said housing; a conduit for transmitting air under pressure into said housing at said first side of said housing; a flow controller providing an orifice of predetermined size and located in said housing to communicate the interior of said housing with the exterior thereof; a control module including a first circuit for generating an electrical flow signal representative of the flow rate of said air through said orifice; said control module further including an integrating circuit for integrating said flow signal over time for generating a second electrical signal representative of the volume of said air passing through said flow controller, and switch circuit means responsive to said second electrical signal for coupling electrical power to energize said lamp when a predetermined volume of air has passed through said flow controller.

2. The apparatus of claim 1 wherein said housing is characterized as being elongated, said apparatus further comprising means defining a plenum at said first side of said housing, said air being coupled into said plenum, said plenum including a wall having a plurality of spaced apertures for establishing substantially laminar flow of air from said plenum through said housing.

3. The apparatus of claim 2 wherein said flow controller includes a second orifice communicating with the ambient; said control module including a differential pressure sensor having a first inlet port communicating directly with the interior of said housing to sense the pressure therein and a second inlet port communicating directly with said second orifice of said flow controller whereby said differential pressure sensor measures the difference in pressure across said first orifice.

4. The apparatus of claim 2 wherein said integrating circuit includes a voltage to frequency converter circuit receiving said flow signal and generating an output signal having a frequency representative of the flow rate through said first orifice; and a counter circuit receiving the output signal of said voltage to frequency converter circuit for accumulating a count representative of the total flow of air through said first orifice.

5. The apparatus of claim 4 wherein said control module further includes a timer circuit for generating a signal a predetermined time after a start-up cycle has begun, said timer circuit timing out and inhibiting operation of said switching circuit if said counter circuit does not generate a predetermined volume count before said timer circuit times out.

6. The apparatus of claim 5 further comprising a second circuit for generating a first alarm signal, including a visual indicator if the pressure across said first orifice exceeds a predetermined maximum value; and a third circuit for generating an alarm signal and including a visual signal when the pressure across said first orifice is less than a predetermined value, thereby indicating a pressure within said housing below a desired operating range.

7. The apparatus of claim 6 wherein said switch circuit means comprises first and second semiconductor power switches connected in series circuit, said apparatus further comprising circuit means for sensing the condition of said switch circuit means and for indicating a failure when one of said semiconductor power switches fails.

8. The apparatus of claim 6 wherein said switching circuit means includes first and second TRIAC semiconductor switches connected in series circuit and when said fault sensing circuit senses that one of said TRIACs has failed in a shorted mode, said fault sensing circuit inhibits operation of said control module upon detection of such fault.

9. The apparatus of claim 1 further comprising fourth and fifth circuits responsive to said representative of said differential pressure across said first orifice, said fourth circuit generating an enable signal when said differential pressure exceeds a first predetermined limit for enabling said integrating circuit; said fifth circuit generating a disable signal when said differential pressure falls below a second predetermined level, lower than said first level for inhibiting the coupling of power to said lamps, said control circuit means initiating a start-up purge cycle when said fourth circuit generates said enable signal until said integrating circuit indicates a predetermined volume of gas has flowed through said fixture.

10. The apparatus of claim 9 wherein said control module is embedded in epoxy.

* * * * *